United States Patent [19]

Langston

[11] 4,367,872

[45] Jan. 11, 1983

[54] ATHLETIC ACCESSORY

[76] Inventor: Herbert Langston, 401 E. 32nd St., Chicago, Ill. 60616

[21] Appl. No.: 188,582

[22] Filed: Sep. 18, 1980

[51] Int. Cl.[3] ..... A63B 69/36; A63B 69/00

[52] U.S. Cl. ..... 273/54 B; 273/189 A; 403/100

[58] Field of Search ..... 273/54 B, 189 A; 403/100

[56] References Cited

U.S. PATENT DOCUMENTS

| | | | |
|---|---|---|---|
| 57,656 | 9/1866 | Alden | 403/100 X |
| 663,857 | 12/1900 | Browder | 403/100 |
| 1,226,160 | 5/1917 | Allis | 273/54 B X |
| 1,457,710 | 6/1923 | MacDonald | 273/189 A X |
| 2,649,104 | 8/1953 | Militano | 403/100 X |
| 2,895,757 | 7/1959 | Kaspar | 403/100 |
| 2,901,263 | 8/1959 | Van Loon | 280/47.37 R X |
| 4,132,407 | 1/1979 | Davis | 273/54 B |

*Primary Examiner*—Anton O. Oechsle

*Attorney, Agent, or Firm*—Gary, Juettner & Pyle

[57] ABSTRACT

An athletic accessory, which serves to permit an athlete normally to bend a jointed limb at will, but, at a critical time, to lock the limb in a fully extended, straight position, such as a bowler's arm during delivery of the ball, comprises two rigid members, a pivot for pivotally connecting the rigid members, supports and straps for attaching the rigid members to the upper and lower limb members of a jointed limb with the pivotal connection coincident with the joint, a sleeve for locking the rigid members together in a straight line, and an internal spring for governing the operation of the locking sleeve to cause the same to lock the rigid members and thus the user's limb in a straight line at the critical time in the athletic endeavor.

3 Claims, 11 Drawing Figures

ATHLETIC ACCESSORY

BACKGROUND OF THE INVENTION

In many sports the ability of an athlete to control the movement of his limbs is the key to his success. For example, in the sport of bowling, it is imperative that the bowler keep his arm straight and elbow locked during the delivery of the ball and follow-through after release. Even a slight bending of the elbow at this critical time will cause the ball to stray from the target. Many bowlers unconsciously, or as a result of a distraction, bend their arms during delivery of the ball causing missed shots and poor games. Athletes in other sports (e.g. golf, swimming, etc.) suffer similar mishaps due to an inability to keep a limb straight at the critical time.

It would be desirable to have a device which permitted an athlete to bend his arm or leg at will, but which would, at a critical time, lock the limb in a fully extended, straight position.

SUMMARY OF THE INVENTION

In accordance with the present invention, an athletic accessory is provided having two pivotally connected rigid members strapped to the upper and lower limb members of an athlete's jointed limb. The pivot is located coincident with the axis of rotation of the athlete's limb joint. Muscular extension of the limb causes the rigid members to longitudinally align, whereupon a locking means, located on one of the rigid members, which is normally held in a dormant position permitting free rotation about the pivot, is activated by spring means, or in the alternative by the force of gravity, to engage the other rigid member. The rigid members are thereby locked in a longitudinally continuous rigid assembly, thereafter preventing the athlete from inadvertantly bending the limb.

Consequently, the athletic accessory of this invention can be of great use to an athlete in providing mechanical assistance for controlling the movement of a limb. For example, in bowling, the bowler begins his delivery by first extending the ball forward and then, while moving towards the foul line, the bowler brings the ball backwards in a sweeping motion. When the bowler's arm is fully extended at the end of the backswing, the locking means of this invention engages, locking the rigid members into a longitudinally continuous rigid assembly. The bowler then reverses the direction of movement of his arm, bringing the ball forward in delivery. The now rigid assembly of this invention holds the bowler's arm in a fully extended position, preventing the bowler from bending his elbow while delivering the ball and during follow-through. As a result, the ball will roll down the alley free from adverse effects which may have been caused by the bowler improperly bending his arm. In addition, with this problem now solved, the bowler is free to concentrate on other aspects of the sport, such as aim, balance and wrist control. Consequently, the bowler will bowl with greater skill and accuracy, resulting in higher scores.

Other objects, advantages and features of this invention, and its application to other sports will become apparent from the following detailed description taken in conjunction with the accompanying drawings.

DETAILED DESCRIPTION

Figure 1:
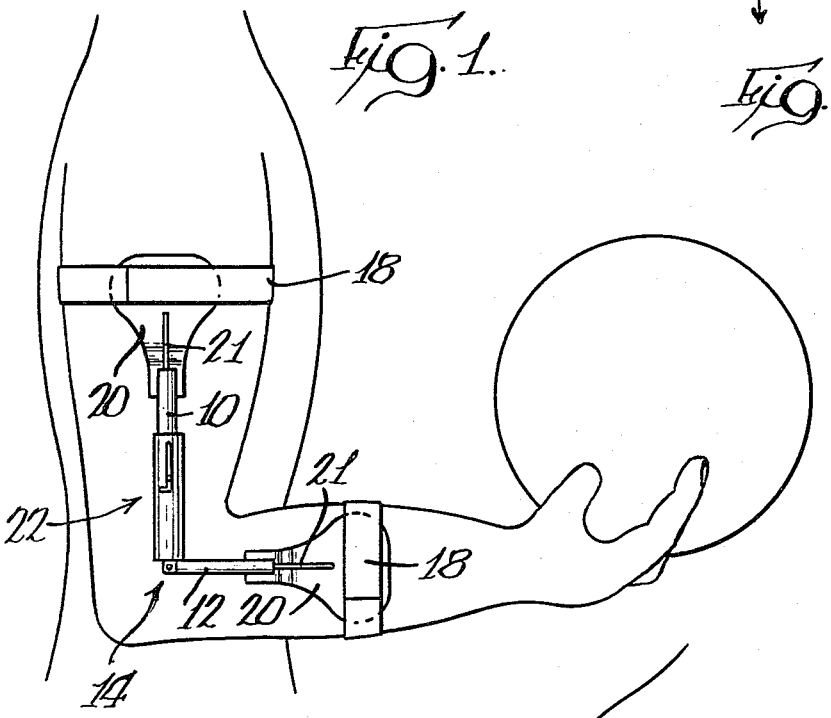
FIG. 1 is a side view of the athletic accessory of the invention, shown as attached to an athlete's right arm, and indicating its applicability to the sport of bowling. In this view, the locking means is shown in a disengaged position.

Referring to the drawings, an upper rigid member 10 is pivotally connected to a lower rigid member 12 by a pivotal connection indicated generally at 14. The rigid members may be fabricated from a rigid, durable, light weight material, such as plastic or aluminum in the shape of a rod, bar, tube, channel or like configuration capable of resisting forces and moments without exhibiting excessive transverse deflections. Each of the rigid members 10 and 12 is of a length somewhat shorter than the respective limb member to which it is attached, but of sufficient length to accommodate means for attaching the rigid member to the limb.

The pivot connection, indicated generally at 14, may be of any conventional construction. The embodiment shown in detail in FIGS. 6–10 illustrates one method of constructing the pivot so that a sliding sleeve 24 will slide freely over the pivot without snagging. In this embodiment, the connection is made by cutting a slot 48 into the lower end of the upper rigid member 10 and by cutting away from the opposing sides of the upper end of the lower rigid member 12 to form a tongue 50 which will fit snugly in the slot 48. The tongue 50 is fitted into the slot 48 and a hole is drilled through the intersection, normal to the cut surfaces, and a pivot pin 16 is press fit or otherwise inserted through the hole to form the pivotal connection. The pivot pin 16 may be made from the same material as the rigid members 10 and 12, or any other suitable material.

Figure 8:
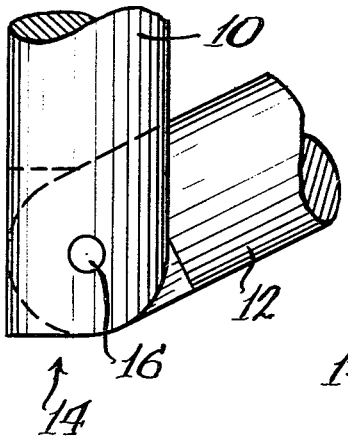
FIG. 8 is a side view detail of the pivot means, illustrating the rigid members at an acute angle to each other.
Figure 9:
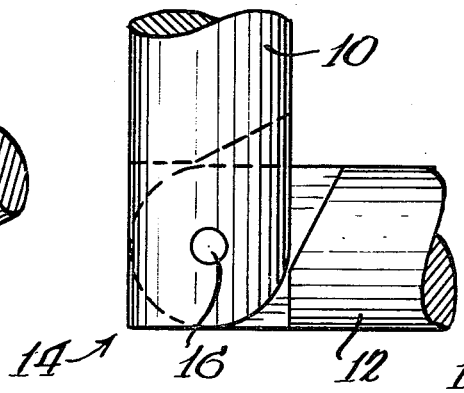
FIG. 9 is a side view detail of the pivot means, similar to FIG. 8, illustrating the rigid members approximately normal to each other.
Figure 10:
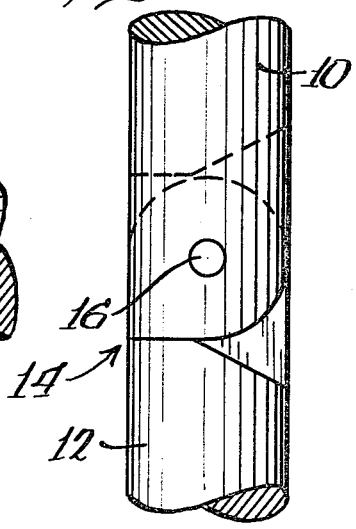
FIG. 10 is a side view detail of the pivot means, similar to FIGS. 8 and 9, illustrating the rigid members in longitudinal alignment.
Figure 11:
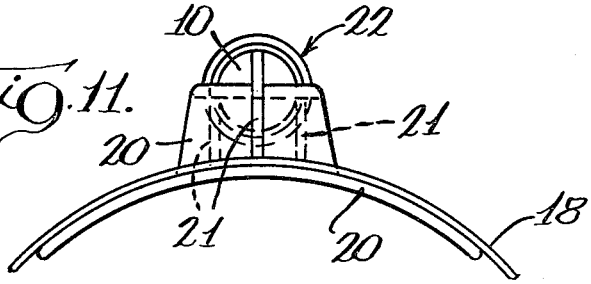
FIG. 11 is an end view taken in the direction of the arrows 11—11 of FIG. 3, illustrating the attaching means.

The end of the tongue 50 is rounded to prevent its protrusion beyond the limits of the upper rigid member 10 when the members are pivotally interconnected, see FIGS. 8, 9 and 10. The lower end of the bifurcated portion of the upper rigid member 10 (as formed by the slot 48), indicated generally at 42, is also rounded at one side to provide clearance for the lower rigid member 12. Part of the inner margin of the bifurcated portion of the member 10, indicated generally at 44, is cut at an angle; and parts of the member 12, at opposite sides of the tongue 50, indicated generally at 46, are similarly cut at a mirror image angle to permit the rigid members 10 and 12 to be pivoted in one direction to an acute angle relative to one another, as shown in FIG. 8.

In the opposition direction of pivotal movement, rotation beyond the point of longitudinal alignment of the members 10 and 12 is prevented by flattened surfaces 38 on the lower ends of the bifurations on the member 10, which butt against flattened surfaces 40 provided on the member 12, at opposite sides of the tongue 50, as shown in FIG. 10. The rigid members 10 and 12 are therefore permitted to rotate about the pivot 14 from the acute angle shown in FIG. 8 to the longitudinally continuous, straight-line position shown in FIG. 10, following the sequence illustrated in FIGS. 8, 9 and 10.

Means for attaching the two rigid members 10 and 12 to respective limb members of a jointed limb preferably comprise a flexible strap 18 and a support 20 at the free end of each of the members 10 and 12. These serve to firmly but comfortably attach the rigid members 10 and 12 to the respective limb members and to retain the same against any substantial movement relative to the respective limb member. The supports 20 are used to elevate the rigid members 10 and 12 off the athlete's limb to provide clearance for a locking means, which is indicated generally at 22. The supports 20 also prevent the rigid members 10 and 12 from rotating out of position when the device is in use, and contribute to the comfort of the user. The strapping means 18 are used to firmly affix the device to the athlete's limb so as to prevent the device from slipping out of position while in use.

The supports 20 comprise an end portion 25; a tongue 19 and an elevating portion 23 therebetween, and are connected to the ends of the respective rigid members 10 and 12 by fitting the tongue 19 of the support 20 into a slot cut into the end of the respective rigid member. The connection is secured by gluing or welding the support 20 to the respective member, and the connection is stiffened and strengthened by reinforcing ribs or struts 21, which may be molded integrally with the supports 20. The end portions 25 of the supports 20 are curved to fit snugly against the athlete's limb, and together with the straps 18 retain the assembly against movement while the device is in use. The elevating portions 23 of the supports 20 elevate the rigid members 10 and 12 off the athlete's limb to provide clearance for the sleeve 24. The supports 20 may be molded from a light weight durable plastic such as poly vinyl chloride or from aluminum.

The straps 18 may be attached to the end portions 25 of the supports 20 with mechanical fastenings, by heat sealing, or by gluing. In a preferred embodiment, the strap is passed through a slot adjacent one side edge of the support 20 and stitched to itself. The straps 18 may be made from any conventional strapping material. The straps may be adjusted about the user's limb and fastened in any conventional manner, such as coherent fasteners, snaps, buckles or other suitable, adjustable fastening devices.

The rigid members 10 and 12 are adapted to be locked together in longitudinal alignment with one another by a locking means, indicated generally at 22. In the preferred embodiment, the means 22 is comprised of a sleeve 24 slidably mounted on the upper rigid member 10, a stop pin 26 extending through a bayonet slot 38 in the sleeve which governs the extent of slidable movement of the sleeve, and a spring 32 which biases the sleeve toward locking position. The sliding sleeve 24 is fabricated from a rigid, durable material, such as poly vinyl chloride, aluminum or steel. The sleeve 24 has internal surfaces generally complementary to the exterior of the rigid members 10 and 12 and has a slidable or slip fit thereon. In the embodiment shown, wherein the rigid members 10 and 12 are circular rods, the sliding sleeve 24 is preferably a tube having an inner diameter slightly greater than the outer diameter of the upper portion of the upper rigid member 10. Other configurations may of course be used as desired.

The upper rigid member is formed of one diameter at its upper end and of a reduced diameter at its lower end whereby to form a shoulder 34 facing toward its lower end within the interior of the sleeve 24. The sleeve 24 is provided at its lower end with an internal flange or shoulder 36 opposed to the shoulder 34, whereby the reduced diameter portion of the member 10, the sleeve 24 and the shoulders 34 and 36 define a chamber for reception of a compression spring 32. The upper end of the spring 32 is butted against the shoulder 34 and the lower end thereof is butted against the shoulder 36, whereby to bias the sleeve downwardly and to provide the motivating force required to thrust the sliding sleeve 24 into locking position. Specifically, when the members 10 and 12 are aligned longitudinally and the sleeve is released for movement, the spring drives the sleeve down over the pivot 14, and into surrounding relationships with both of the rigid members 10 and 12, thereby to lock the rigid members together in a longitudinally continuous rigid assembly. If the sliding sleeve 24 is made of a heavy material such as steel, the spring 32 may be omitted in favor of reliance upon gravity and/or centrifugal force to provide the motivating force required.

A vertically disposed bayonet slot 28 with a horizontal slot portion 30 is cut through the sliding sleeve 24 to accommodate the stop pin 26 for the two-fold purposes of limiting the travel of the sliding sleeve and for locking the sliding sleeve in an inoperative or dormant position. The stop pin 26 may consist of an ordinary machine screw, screwed into a threaded hole in the upper rigid member 12; or may be made from plastic and glued into place. The vertical portion of the slot 28 is of sufficient length, relative to the location of the screw, to accommodate sliding movement of the sleeve 24 from an upper, inoperative position, wherein it is spaced above the pivot, to a lower, locked position, wherein it surrounds the pivot and engages both of the members 10 and 12. The sliding sleeve 24 may be held in the inoperative position by rotating the sliding sleeve 24 so that the horizontal slot portion 30 of the bayonet slot receives the stop pin 26, whereby the pivot 14 is clear of obstruction and the user may move his limb freely. Rotating the sliding sleeve 24 so that the stop pin 26 is received in the vertical portion of the slot 28 will activate the locking means to "ready" condition. When the athlete thereafter extends his limb causing the upper and lower rigid members 10 and 12 to become longitudinally aligned, the sliding sleeve 24 will travel over the pivot 14 and engage the lower rigid member 12. Further movement of the sleeve is prevented by reason of the upper margin of the slotted portion of the sleeve engaging the stop pin 26. The sliding sleeve 24 is then positioned over the pivot 14 thereby preventing rotation of the rigid members 10 and 12 about the pivot.

Figure 2:
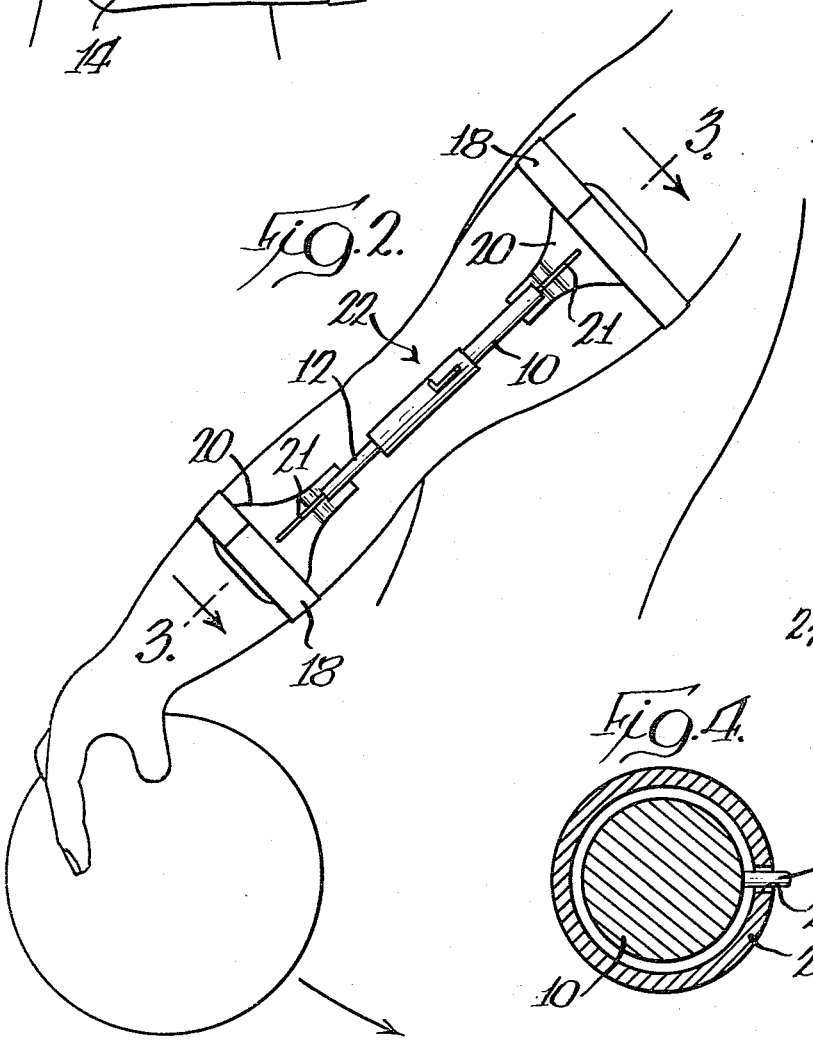
FIG. 2 is a side view of the athletic accessory, similar to FIG. 1, illustrating the bowler'sarm extended and the locking means engaged and holding the athlete's arm in a fully extended, locked position.
Figure 3:
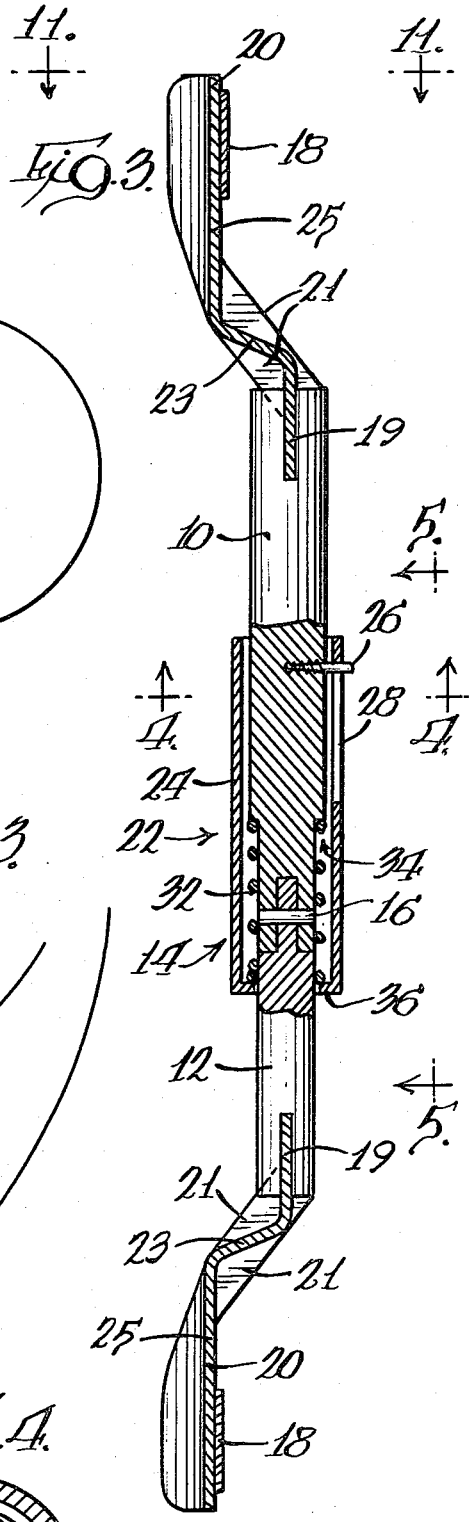
FIG. 3 is longitudinal vertical section of the athletic accessory taken along line 3—3 of FIG. 2.
Figure 4:
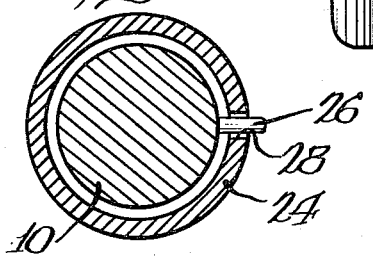
FIG. 4 is a transverse section taken along line 4—4 of FIG. 3 illustrating the locking means of the accessory.
Figure 5:
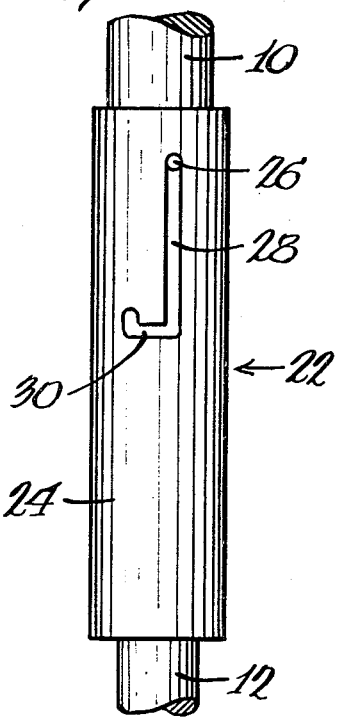
FIG. 5 is a side view detail taken in the direction of the arrows 5—5 of FIG. 3, illustrating in detail the locking means.
Figure 6:
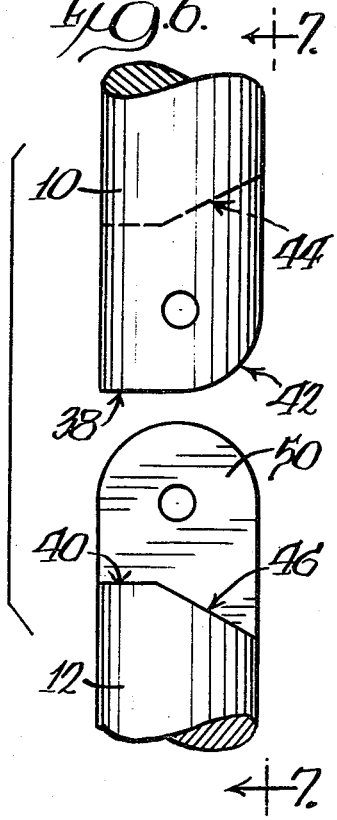
FIG. 6 is an exploded detail of the pivot means illustrating one method of snag free construction.
Figure 7:
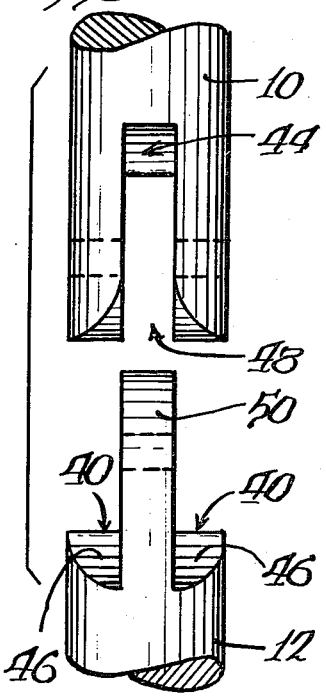
FIG. 7 is an exploded front view detail of the pivot means taken in the direction of the arrows 7—7 of FIG. 6.

The operation of the device in respect of the sport of bowling is illustrated diagrammatically in FIGS. 1 and 2. As shown, the upper rigid member 10 is strapped to the user's upper arm and the lower rigid member 12 is similarly strapped to the user's lower arm, with the pivot 14 coincident with the axis of rotation of the user's elbow. As the bowler approaches the lane, the sliding sleeve 24 is rotated into "ready" position with the stop pin 26 engaged in the vertical portion of the slot 28. (see FIG. 1). The bowler begins, as shown in FIG. 1, addressing the lane with his arm bent. Then, while moving toward the foul line, the bowler swings the ball down and back in a sweeping motion. When the bowler's arm becomes fully extended at the end of the backswing, as shown in FIG. 2, the sliding sleeve 24 travels downwardly, by force of the spring 32, and passes over the pivotal connection 14 and engages the adjacent ends of the two rigid members 10 and 12 respectively, thereby locking said rigid members into a longitudinally continuous rigid assembly. The bowler then reverses the direction of movement of his arm, bringing the ball forward in delivery. The now rigid assembly of this invention holds the bowler's arm in a fully extended position, preventing the bowler from bending his elbow while delivering the ball and during the follow-through of his swing. As a result, the ball will roll down the alley free from adverse effects which may have been caused had the bowler improperly bent his arm.

To reset the device, e.g., for rolling the second ball in a frame, the user merely pushes the sliding sleeve upwardly to clear the pivot and bends his arm (even slightly), thereby to return the device to its "ready" position. Between frames, the slide is simply moved upwardly to the extent permitted by the vertical portion of the bayonet slot and rotated to dispose the stop pin in the horizontal slot portion of the slot, whereupon the device is rendered inoperative and the user can bend his arm back and forth in normal fashion without hindrance from the device.

The invention thus provides a highly effective and very economical accessory for holding an athlete's limb in an extended position at a critical point in an athletic endeavor, without otherwise impairing the athlete's participation in the sport.

While the preferred embodiments of the invention, and a representative mode of use thereof, have been illustrated and described herein, it is to be appreciated that changes, modifications and variations may be made therein without departing from the scope of the invention as defined by the appended claims.

What is claimed is:

1. An athletic accessory comprising:

a pair of rigid members;

pivot means for pivotally connecting said rigid members;

attaching means for securing each of said rigid members to the corresponding limb members of a jointed limb of an athlete, with said pivot means located coincident with the axis of rotation of the athlete's limb joint;

a sleeve slidably mounted on and encircling one of said rigid members adjacent said pivot means and movable between a first position accommodating pivotal movement of said rigid members and the athlete's limb members and, upon longitudinal alignment of said rigid members, a second position overlying said pivot means and engaging the adjacent ends of said rigid members to lock said rigid members in longitudinal alignment for thereby preventing the athlete from inadvertently rotating the limb joint, said sleeve having a vertically disposed bayonet slot cut through said sleeve;

a stop pin mounted on said one of said rigid members extending slidably through the bayonet slot in said sleeve for limiting the travel of said sleeve;

a shoulder on said one of said rigid members, underlying said sleeve and facing toward said pivot means;

an internal flange on said sleeve facing toward said shoulder to define a chamber between said sleeve, said shoulder and said internal flange; and a compression spring located within said chamber biased at one end against said shoulder and at the other end against said internal flange, for resiliently biasing said sleeve toward the other rigid member.

2. An athletic accessory according to claim 1, wherein said pivot means comprises a slot cut into the end of one of said rigid members, a tongue on the adjacent and of the other of said rigid members and a pivot pin extending into a hole passing through the intersection of said rigid members normal to said slot and said tongue, wherein part of the inner margin of the slot cut into the end portion of one of said rigid members is cut at an angle to said rigid members, and the other said rigid member is provided with a portion adjacent to said tongue cut at a mirror image angle to the first said angle, for permitting said rigid members to be pivoted in one direction to an acute angle relative to one another.

3. An athletic accessory according to claim 1, said attaching means each including:

a support having an end portion, a tongue and an elevating portion therebetween, said end portion being curved to fit snugly against the athlete's limb, said tongue being rigidly secured to the end of the respective rigid member opposite said pivot, said elevating portion elevating said tongue and the respective rigid member off the athlete's limb to provide clearance between the athlete's limbs and said rigid members and said sleeve for insuring unimpaired movement of the limbs, said rigid members and said sleeve.

* * * * *